US008590242B1

(12) United States Patent
Ogorchock

(10) Patent No.: US 8,590,242 B1
(45) Date of Patent: Nov. 26, 2013

(54) INSULATED CONCRETE WALL

(76) Inventor: Thomas J. Ogorchock, Haymarket, VA (US)

( * ) Notice: Subject to any disclaimer, the term of this patent is extended or adjusted under 35 U.S.C. 154(b) by 102 days.

(21) Appl. No.: 12/660,698

(22) Filed: Mar. 3, 2010

Related U.S. Application Data

(60) Provisional application No. 61/209,163, filed on Mar. 4, 2009.

(51) Int. Cl.
*E04B 2/18* (2006.01)
*E04B 2/26* (2006.01)

(52) U.S. Cl.
USPC ..... 52/405.3; 52/463; 52/461; 52/745.13; 52/745.06

(58) Field of Classification Search
USPC ..... 52/405.3, 460, 463, 464, 468, 461, 52/745.13, 745.06, 745.15
See application file for complete search history.

(56) References Cited

U.S. PATENT DOCUMENTS 3,435,581 A * 4/1969 Ahlqvist ..... 52/405.1
3,512,819 A * 5/1970 Gillingwater et al. ..... 52/461
3,531,901 A * 10/1970 Will, Jr. et al. ..... 52/309.14
3,583,118 A * 6/1971 Lowery ..... 52/309.5
4,015,387 A * 4/1977 Tillie ..... 52/309.17
4,079,560 A * 3/1978 Weismann ..... 52/309.7
4,512,126 A * 4/1985 Walston ..... 52/251
4,625,484 A * 12/1986 Oboler ..... 52/251
4,674,242 A * 6/1987 Oboler et al. ..... 52/91.2
4,841,702 A * 6/1989 Huettemann ..... 52/309.12
4,972,537 A * 11/1990 Slaw, Sr. ..... 14/77.1
4,998,393 A * 3/1991 Baena ..... 52/236.9
5,398,470 A * 3/1995 Ritter et al. ..... 52/309.11
5,930,965 A * 8/1999 Carver ..... 52/320
5,934,036 A * 8/1999 Gallagher, Jr. ..... 52/323
6,519,904 B1 * 2/2003 Phillips ..... 52/309.12
7,523,591 B2 * 4/2009 Di Lorenzo ..... 52/414
7,627,997 B2 * 12/2009 Messenger et al. ..... 52/309.17
7,739,844 B2 * 6/2010 Gharibeh et al. ..... 52/309.8
7,828,544 B2 * 11/2010 Di Lorenzo ..... 425/441
7,836,660 B2 * 11/2010 Gharibeh et al. ..... 52/745.01
7,882,672 B2 * 2/2011 Emblin ..... 52/426

FOREIGN PATENT DOCUMENTS

FR 2558865 A1 * 8/1985
FR 2615547 A1 * 11/1988
FR 2661702 A1 * 11/1991
FR 2670523 A1 * 6/1992

* cited by examiner

*Primary Examiner* — Phi A

(57) ABSTRACT

A shaped insulation insert, an insulated concrete wall structure, and a method of producing same is disclosed. The insert is to be embedded in a concrete wall and comprises an elongate, rigid foam insert including an integrally formed base section and cap section symmetrically disposed on the base section. The elongate insert has a length sufficient to form a vertical interior surface expanse of the concrete wall, and flat side surfaces that are sufficient to enable a plurality of inserts to be placed horizontally side-by-side to form a horizontal interior surface expanse of the concrete wall. The insert includes opposed end sections extending from outer ends of the intersection of the cap and base sections to an outer edge portion for disposing adjacent inserts in the concrete wall. The insulated concrete wall structure comprises an interior section including an inner insulation portion effective to produce a saving of concrete. The insulation portion includes a plurality of shaped elongate insulation inserts embedded in an outer concrete portion. The elongate inserts each has flat side edge sections on outer edge portions and coupling devices grasp facing flat side edge sections of juxtaposed inserts each having flat edges to interconnect juxtaposed inserts in their side-by-side disposition. Vertical re-bar and horizontal reinforcement rods within the concrete portion provide strength compensation for the lesser amount of concrete used in the production of the concrete wall.

18 Claims, 6 Drawing Sheets

INSULATED CONCRETE WALL

RELATED APPLICATION

This is a non-provisional application of the Provisional Application 61/209,163 filed Mar. 4, 2009 priority of which is claimed.

BACKGROUND OF THE INVENTION

1. Field of the Invention

This invention relates generally to insulated concrete walls. More particularly, the invention relates to an insulation layer specifically shaped to provide an insulated concrete wall having vertical and horizontal reinforcement rods that compensate for a lesser amount of concrete required in a concrete wall.

2. Description of the Prior Art

Insulated concrete walls are well known. Many have various combinations of interior and/or exterior insulation wall layers that produce typical insulated concrete walls. Of particular interest is a concrete wall with an interior, embedded insulation layer that minimizes use of the interior room space and substantially eliminates the need to build out into the interior space of the room being formed. None of the prior art insulated concrete wall structures are designed with an embedded insulation to achieve this desired result.

U.S. Pat. No. 3,995,825 reveals an upright concrete form structure having two (2) facing side forms that are laterally spaced to form a mold cavity into which concrete is poured to form a concrete wall. Once the concrete is cured, the side forms and the break off ends of the tie bar are removed. U.S. Pat. No. 2,825,221 discloses a well known horizontally disposed concrete form into which masonry panels are placed and concrete poured into the form. When cured, the structure is tilt-up to an upright position.

U.S. Pat. No. 840,804 discloses a wall plug for holding cavity wall panels in place. A concrete embedded portion connects to a top portion that fits over the juxtaposed edges of panels that form the outer mold surfaces of a mold cavity into which concrete is to be poured. Once the concrete is hardened, the wall panels are removed and the extension section that held them in place are simply removed to produce a relatively smooth surface to be finished in any desired fashion.

U.S. Pat. No. 4,426,061 discloses apparatus for forming insulated concrete walls. Insulation panels are juxtaposed along their outer edges covered by sheet metal caps that secures a reinforcing wire mesh to the insulation panel. The reinforcing wire mesh is embedded in the mold cavity to hold the insulation panel in place when concrete is poured into the mold cavity. Drywall gypsum boards may be attached to the sheet metal caps of the insulation modules to finish the interior wall.

U.S. Pat. No. 5,692,356 discloses apparatus for the in situ attachment of insulation panels to poured concrete walls as they are formed. F-shaped strips fit over adjacent edges of insulation panels and include projections directed into the mold cavity to be embedded into the hardened concrete. Once the concrete is cured, the embedded projections secure the vertically disposed strips to the outer surfaces of the concrete wall. The strips may be composed of a polymeric material such a polyvinyl chloride, polyethylene, polypropylene, nylon or any of several other available materials.

U.S. Pat. No. 3,535,844 discloses a structural panel having a plurality corrugations when inter-connected within each of the corrugations. The insulation is disposed within forming skins to produce a panel useful in a wall or roof in constructing buildings and provides improved weather sealing and insulating effectiveness. Nothing is revealed that would lead one having ordinary skill in the art to use this panel in an insulated concrete wall structure.

U.S. Pat. No. 5,657,600 reveals the use of foam panels in a spaced parallel relationship and having a plurality of corrugations of different widths. Bridging members are laterally spaced by about 8 inches to maintain the distance between the spaced foam panels for receiving concrete therebetween. No disclosure is found of the panel corrugations being used to displace concrete within the cured structure.

U.S. Pat. No. 5,845,445 discloses a plurality of insulation panels having adjacent edges inter-connected with I-shaped, elongate connecting members that encompass the juxtaposed edges. Each of the connecting members includes a tubular element that extends into a mold cavity and is embedded in concrete poured into the mold cavity.

U.S. Pat. No. 3,994,471 reveals a coupling joint member for casting a seamless ceiling from a hardening material such as concrete. The joint member encompasses juxtaposed edges of insulation panels and includes projecting portions extending into the mold cavity to be embedded in concrete. Use of inner projecting lips or other cross-sectional shapes on C-shaped channels as disclosed in U.S. Pat. No. 4,426,061 may be used to secure the insulation panels to a concrete wall.

U.S. Pat. No. 6,625,947 discloses T-shaped wall studs placed next to juxtaposed insulation panels and having anchor sections that extend into the mold cavity to be embedded in concrete poured into the cavity. Building codes generally require the width of the mold cavity to be at least eight (8) inches. Here the anchor section of the wall stud has a length sufficient to allow different thickness of insulation thicknesses to be used.

PURPOSE OF THE INVENTION

An object of the invention is to provide an insulated concrete wall in which the insulation is shaped and disposed within the mold cavity to displace an amount of concrete in the wall.

Another object of the invention is to provide an insulated concrete wall having a corrugated shape that is embedded in the concrete to produce structural integrity to the wall.

A further object of the invention is to provide an insulated concrete wall having a corrugated shape combined with a disposition of vertical and horizontal reinforcement rods producing structural integrity to the wall.

Still another object of the invention is to provide an insulated concrete wall having insulation embedded in the wall to eliminate the need to use a stud wall to be added to the insulation for a build out into the interior space of the room formed by the concrete wall.

A still further object of the invention is to provide an insulated concrete wall having embedded insulation that forms the interior of the concrete wall to produce the shape needed for structural integrity of the wall.

Another object of the invention is to provide an insulated concrete wall having an R rating of at least about 13, which exceeds most typical building code requirements.

SUMMARY OF THE INVENTION

As is evident from the drawings, the invention is directed to an insulation insert shaped to be embedded in a concrete wall structure. The insert comprises an elongate, rigid foam insert including an integrally formed base section and cap section that is symmetrically disposed on the base section having opposed end sections each with an upper, outer edge portion surface to be embedded in the concrete of a concrete wall structure, and each extending to an opposed outer side surface, said cap section having a top peak cap surface to be embedded in the concrete of a concrete wall structure. The base section includes a bottom outer surface opposed to said upper, top peak cap surface that extends between said opposed side surfaces. The bottom outer base surface has a length sufficient to form a vertical interior surface expanse of the concrete wall structure, and side surfaces that are sufficient to enable said side surfaces of a plurality of inserts to be placed side-by-side to form a horizontal interior surface expanse of the concrete wall structure. The insert includes opposed end sections extending from opposed intersections of the outer cap surface and the outer edge portion surfaces to the outer side surfaces of the outer opposed end sections for disposing the top peak cap surface and upper, outer edge portion surfaces of adjacent inserts in a concrete portion of the concrete wall structure. The insert is composed of polystyrene foam or any other suitable foam insulation. More specifically, the insert is composed of polymeric material selected from the group of polyvinyl chloride, polyethylene, polypropylene, and nylon, and has an overall width selected from a group of about 15¾" and about 17¾" and a width of the substantially flat peak of the cap section selected from the group of about 8" and about 10".

More particularly, the invention is directed to an insulated concrete wall structure for a building. As it is evident tin the drawings, the wall structure consists essentially of an outer concrete portion and an inner insulation portion effective to produce a saving of concrete. The insulation portion includes a plurality of shaped vertically disposed elongate, rigid foam insulation inserts each having an integrally formed base section and a cap section symmetrically disposed on the base section. The cap section includes a flat, top surface and two opposing side walls each extending from intersections of the cap and base sections to opposed ends of the flat, top surface of the cap section. The cap section side walls of adjacent inserts act to create between adjacent inserts vertically placed concrete columns in the concrete wall structure whereby the columns provide additional lateral and vertical strength to the wall structure. Each base section includes opposed base end sections each with a bottom, outer edge portion surface, and an upper, outer edge portion surface that is embedded in said outer concrete portion, and each base end section extends about 3" outwardly from each intersection of the cap and base sections to opposed outer flat end side surfaces that are perpendicular to said bottom and upper outer edge portion surfaces. Each base end section has an upper, outer edge portion surface embedded in the outer concrete portion, and extends to an opposed outer flat side surface. The cap section includes an outer cap surface embedded in the outer concrete portion. The base end sections each has flat side edge surfaces on the outer edge portions, and coupling means grasp facing flat side edge surfaces with said perpendicular bottom and upper outer edge portion surfaces of juxtaposed inserts to interconnect facing flat end side edge surfaces of juxtaposed inserts. The coupling means thereby interconnect juxtaposed inserts in their side-by-side disposition. Vertical re-bar and horizontal reinforcement rods are located within the concrete portion to provide strength compensation for the lesser amount of concrete used in the production of said concrete wall structure. Each insert has a length sufficient to form a vertical interior surface expanse of the concrete wall structure. The coupling means includes edge strips selected from the group of F-shaped edge strips, H-shaped edge strips, and C-shaped edge strips that inherently fit over and receive adjacent facing flat end side edge surfaces with said perpendicular bottom and upper outer edge portion surfaces of juxtaposed insulation inserts. Each edge strip has inwardly directed projections that are embedded in the concrete portion and are effective to hold the insulation panels in place.

In a specific embodiment, the insulation inserts each include an integrally formed base section and cap section symmetrically disposed on the base section to form an intersection therebetween. The cap section has two inclined side walls and each extend from an outer end intersection of the cap and base sections to opposed outer ends of the width of the flat top of the cap section; and each inclined side wall extends outwardly of the width of the flat top of the cap surface and depends on the amount of incline of the inclined side wall surfaces. The overall depth thickness of the concrete wall structure is selected from the group of about 9¾" to about 11¾"; and the embedded inserts displace about 4" of the concrete at said cap sections in the wall and about 2" of concrete at the adjacent outer edge portions of said inserts. The embedded insulation inserts form the interior of the concrete portion and create a shaped construction having vertically disposed corrugated concrete that acts as vertically placed columns in the concrete wall structure needed to provide structural integrity to the insulated concrete wall.

The invention is also directed to a method for producing an insulated concrete wall structure. The method comprises vertically disposing laterally spaced inner and outer molding surfaces to provide a wall mold cavity for forming the concrete wall structure. The wall mold cavity has an upwardly directed top opening into which hardenable material is to be poured and hardened to produce the wall structure within the wall mold cavity. An inner insulation portion is disposed against the inner molding surface to effectively produce a saving of concrete. The insulation portion includes a plurality of shaped elongate insulation inserts wherein each insert includes an integrally formed base section and a single cap section that is symmetrically disposed on the base section to form opposed intersections therebetween. The base sections each have opposed end wall sections each with a bottom, outer edge portion surface, and an upper, outer edge portion surface. Each end wall section extends to an opposed outer flat end side surface that is perpendicular to the bottom and upper, outer edge portion surfaces. The upper, outer edge portion surfaces, and the cap sections each have a top peak cap surface that are to be embedded in the concrete of a concrete wall structure. The elongate inserts each include an outer edge portion that has a bottom and upper, edge potion surface and flat end side edge surfaces that face adjacent inserts.

As is evident in the written disclosure and drawings, coupling means grasp the bottom and upper, outer edge portion surfaces and the facing flat end side edge surfaces of juxtaposed inserts to interconnect juxtaposed inserts in their side-by-side disposition. The insulation inserts each includes opposed base end sections each extending about 3" outwardly from the opposed intersections of the top peak cap surface of the single cap section to the outer flat end side surfaces of the opposed base end sections. Thus, the top peak cap surface and upper, outer edge portion surfaces of each of the plurality of adjacent inserts is disposed in the concrete of said concrete wall structure. The opposed end sections and cap section each have a thickness of about 2" so that the insert has a thickness of about 4" at its base and cap sections. The insert has an overall width between the outer side surfaces of the outer opposed end sections selected from a group of about 15¾" to about 17¾". The flat top of the cap section has a width selected from a group of from about 8" to about 10", and the width between intersections where the symmetrically disposed cap section twice intersects the base section is from about 10" to about 12". Vertical re-bar is disposed at locations in the molding cavity laterally spaced inwardly from the coupling means connecting the outer edge portion surfaces of insulation inserts. Horizontal reinforcement rods disposed at locations within the molding cavity provide strength compensation for the lesser amount of concrete used in the production of said concrete wall structure. Hardenable material is poured into the top opening and allowed to harden to produce an insulated wall structure within the wall mold cavity having the embedded insulation inserts located on the interior of the mold cavity to create a shaped construction needed to provide structural integrity to the insulated concrete wall structure.

The inner and outer molding surfaces of the mold cavity are removed to reveal the wall structure that includes horizontal reinforcement rods laterally spaced within and inwardly from the cap sections of the insulation inserts. The rods are disposed at a plurality of vertical locations that are laterally spaced with respect to each other within the wall structure. The plurality of shaped insulation inserts provide a corrugated insulation interior wall covering wherein the cap sections have a corrugated form that allows concrete to harden between adjacent cap sections to act as vertically placed columns in the hardened concrete wall structure that provide additional lateral and vertical strength to the wall structure.

Finally, the invention is directed to the use of an unique interior insulated portion of an insulated concrete wall for a home or commercial building. The insulated concrete wall may be formed using an upright, poured-in-place process and apparatus, or may be formed with a horizontal apparatus and once cured, the concrete form is tilt-up into a vertical position for use as a wall. The interior section has an insulation portion that is shaped to be embedded in a concrete portion to form an insulated concrete wall in which a significant saving of concrete is effected. Placement of vertical re-bar and horizontal reinforcement rods within the concrete portion provide strength compensation for the lesser amount of concrete used in the production of the concrete wall.

The insulation portion is shaped to be embedded in the concrete and comprises elongate, rigid foam inserts each including an integrally formed base section and cap section symmetrically disposed on the base section. When upright, the elongate inserts vertically extend a distance sufficient to form the vertical interior surface expanse of the insulated concrete wall. The inserts include flat side surfaces that are sufficient to enable the inserts to be placed horizontally side-by-side to form the horizontal interior surface expanse of the concrete wall. Coupling means grasp facing flat side edge sections to interconnect the inserts in their side-by-side disposition. In specific embodiments, F-shaped edge strips, H-shaped edge strips, or C-shaped edge strips receive the juxtaposed edges of the insulation inserts. Each of the strips have inwardly directed projections that are to be embedded in the concrete to hold the insulation panels in place.

When disposed in place, the shaped multiple inserts provide a corrugated insulation interior wall covering wherein the cap sections have a corrugated form that acts to provide vertically placed concrete columns in the concrete wall between the inclined side walls of adjacent cap sections of the inserts that provide additional lateral and vertical strength to the wall. The embedded insulation forms the interior of the concrete wall and creates the shaped construction needed to provided structural integrity to the insulated concrete wall. Additional strength is provided by vertical and horizontal reinforcing rods within the wall to maintain the structural integrity of the wall. Vertical re-bar or reinforcement rods are placed within the concrete at locations within the concrete allowing space to place the tie bars between the corrugations for holding the mold cavity panels that provide wall surfaces of the cavity. Horizontal reinforcement rods are located substantially at the middle of the concrete depth and vertically spaced at about 24" with respect to each other.

Each insert has a width that enables two (2) inserts to be juxtaposed providing an overall width that enables tie bars to interconnect wall cavity panels. In a specific embodiment, the wall panels may have a width of about 32" or about 36" and may be composed of wood, metal, or other suitable material. In a brick supporting wall, the cavity panels are laterally spaced at about 11½", and in a wall that does not support laid brick, the cavity panels are laterally spaced at about 9½".

BRIEF DESCRIPTION OF DRAWINGS

Other objects of this invention will appear in the following description, reference being made to the accompanying drawings forming a part of the specification wherein like reference characters designate corresponding parts to the several views.

DETAILED DESCRIPTION OF SPECIFIC EMBODIMENTS

Figure 1:
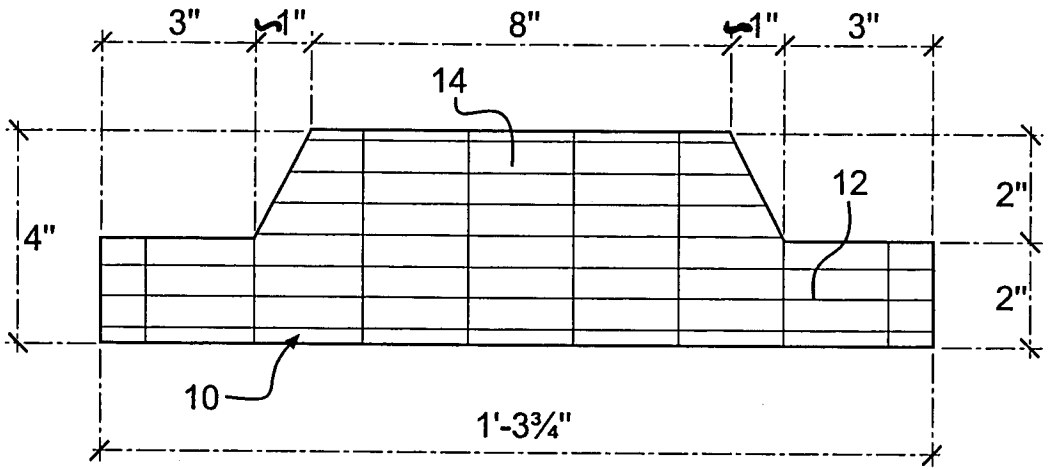
FIG. 1 is a top plan view of an insulation insert for an insulated concrete wall of the invention.

Referring to FIG. 1, a specific embodiment of foam insert 10 has base section 12 with a width of about 15¾" and cap section 14 with a width of about 10" where cap section 14 meets base section 12 to a width of about 8" at the peak of cap section 14. The width of the two (2) inclined portions extending from the outer ends of the intersection of the cap and base sections, and the outer ends of the width of the peak of cap section 14 is less than about 1" as shown and depends on the amount of incline of the inclined portions. Insert 10 also includes end sections extending about 3" from the outer ends of the intersection of the cap and base sections to the outer edge portions. Insert 10 is about 4" thick at its base and cap sections 12,14 and about 2" thick along its outer edge portions of base section 12. When base section 12 has a width of about 17¾" wide for 36" wide mold cavity panels, cap section 14 has a width of about 12" where cap section 14 meets base section 12 to a width of about 10" at the peak of cap section 14.

In a poured-in-place method and structural forming assembly, interior and exterior wall molding panels form laterally spaced, opposed molding surfaces that define a wall mold cavity for forming a wall structure. The wall panels are vertically disposed and laterally spaced to provide the molding surfaces along opposed sides of the wall mold cavity. When 32" wide mold cavity panels form interior and exterior opposed inner mold cavity surfaces, two (2) 15¾" wide foam inserts 10 are interconnected side-by-side with coupling means and placed against the interior surface. Tie members fix the position of the inner mold cavity wall surfaces at a spaced distance of about 11½". When the 15¾" side of insert 10 is disposed against the interior wall of the mold cavity, the 4" thickness of insert 10 extends into the mold cavity.

When 36" wide panels form opposed mold cavity surfaces, two (2) 17¾" wide foam inserts 10 are placed side-by-side against the interior surface within the mold cavity. The inserts may be composed of polystyrene foam or any other suitable foam insulation. Type 1 Expanded Polystyrene insulation at 40° F. has an R value of 4 per inch so that the insulation has an average thickness of 3.25 inches in this embodiment resulting in an R value rating of 13.

Figure 2:
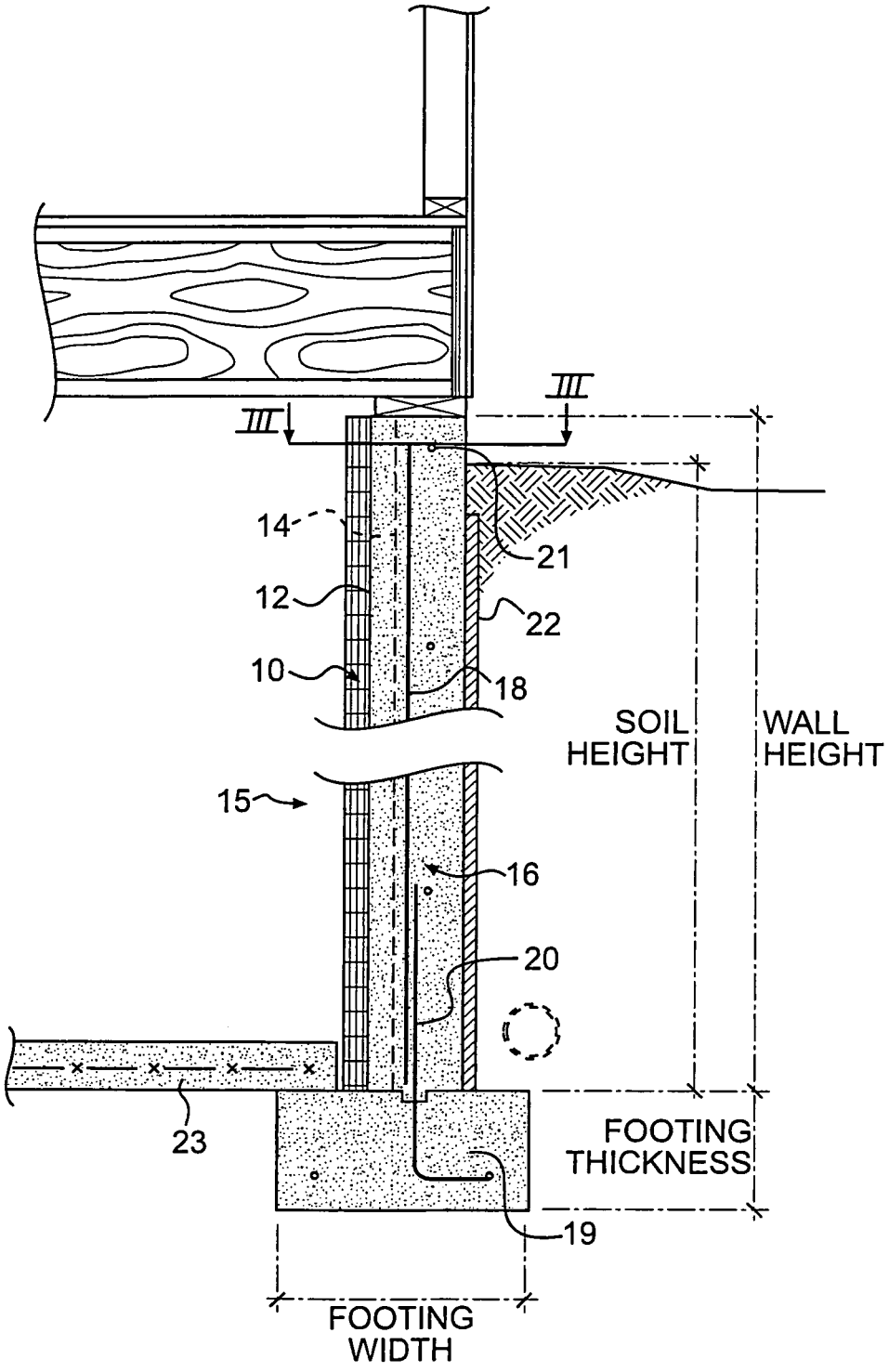
FIG. 2 is a cross-sectional view of an embodiment of an insulated concrete basement wall structure of the invention.
Figure 3:
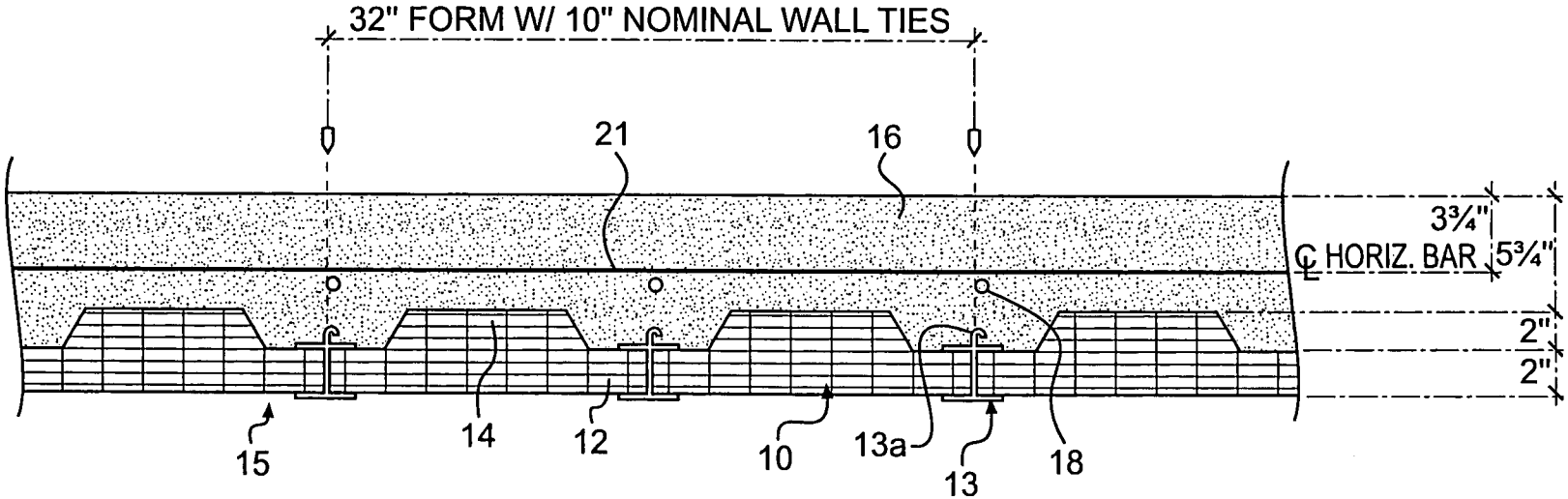
FIG. 3 is a top sectional view along line III-III in FIG. 2 of the shown embodiment of the insulated concrete basement wall structure made according to the invention.

The wall structure, generally designated 15 and shown without the mold cavity panels in FIGS. 2 and 3, includes juxtaposed foam inserts 10 with base sections 12 and cap sections 14 embedded in concrete 16. The overall depth of wall structure 15 in this embodiment is about 9¾". The embedded inserts 10 displace about 4" of the concrete at corrugations or cap sections 14 in the wall and about 2" of concrete at the adjacent outer edge portions of inserts 10 as shown in FIG. 3. Vertically disposed metal re-bar rods ½" in diameter extend upwardly within concrete 16 and ½" diameter metal rods 20 extend upwardly about 24" from footing 19. Horizontal reinforcement rods 21 are located 24" on center in the concrete 16.

Figure 4:
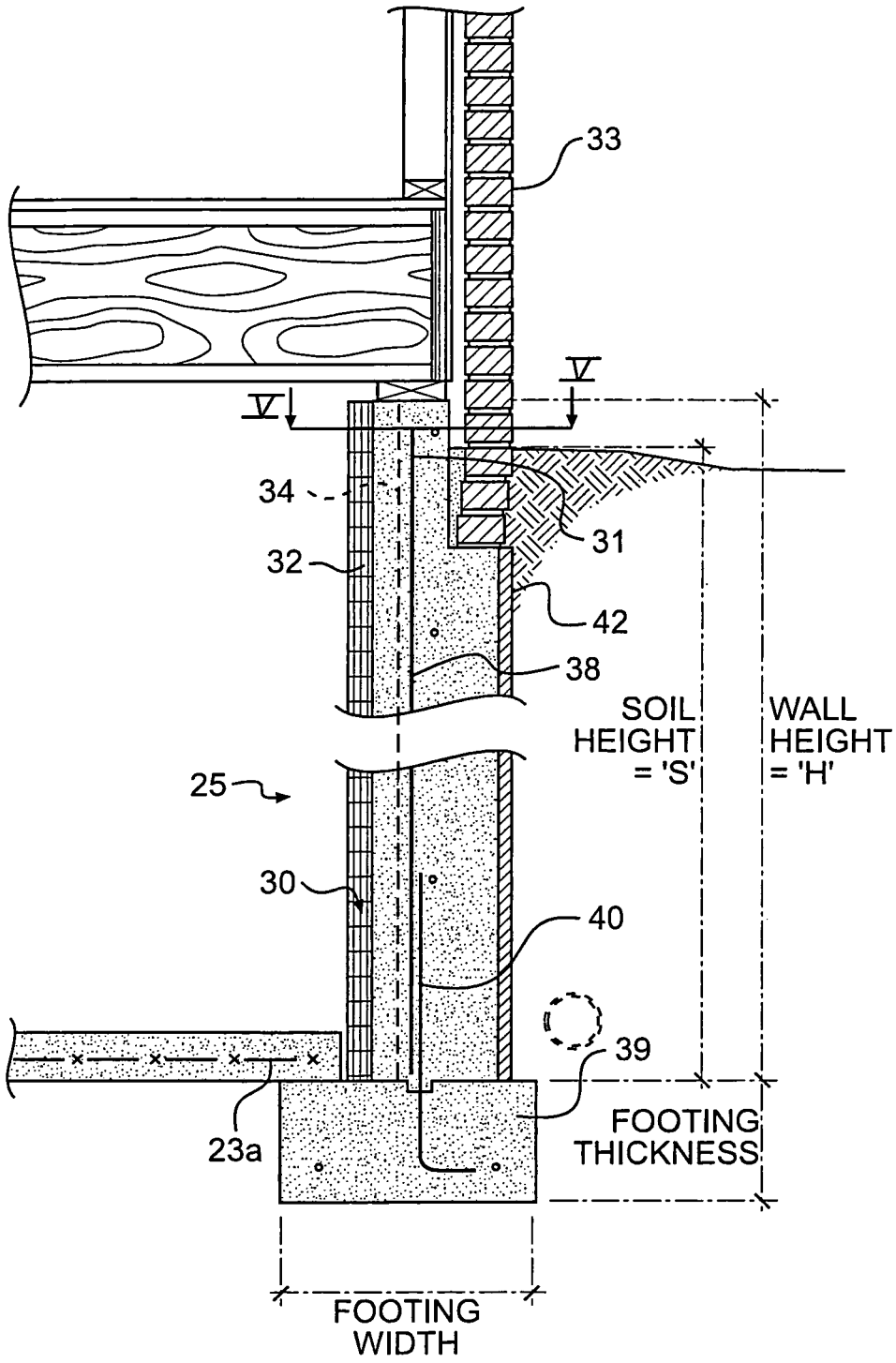
FIG. 4 is a cross-sectional view of another embodiment of an insulated concrete basement wall structure of the invention for supporting an upper brick veneer.
Figure 5:
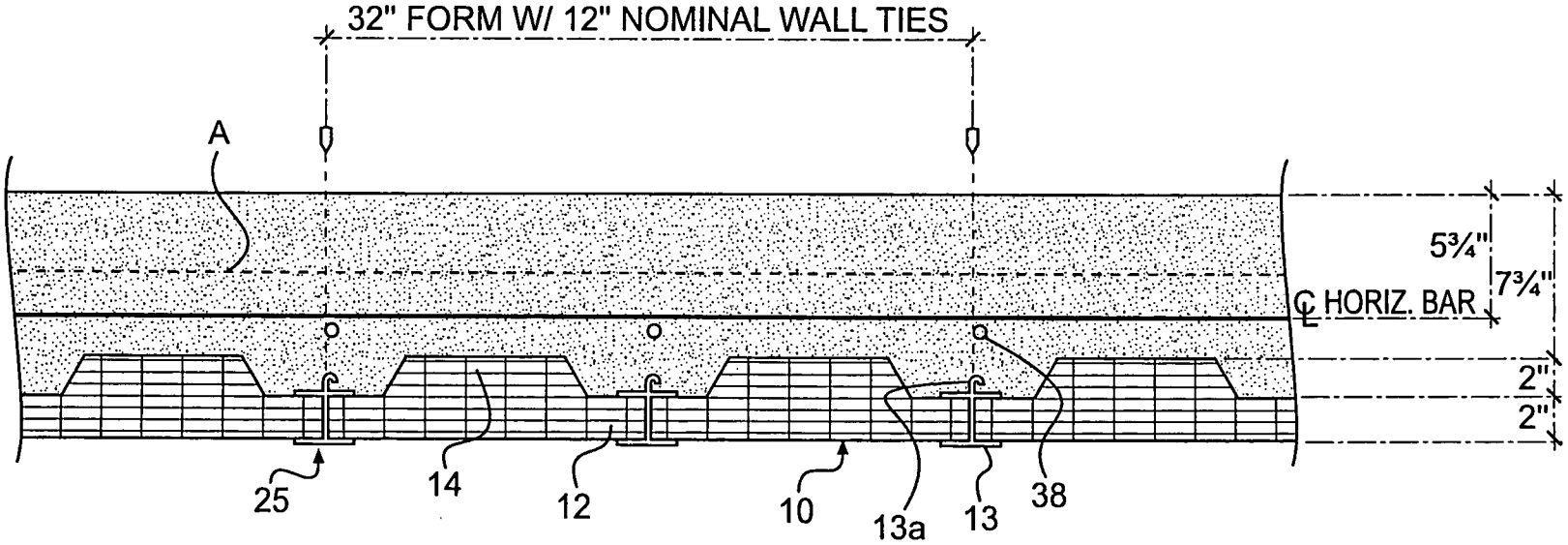
FIG. 5 is a top sectional view along line V-V in FIG. 4 of the shown embodiment of the insulated concrete basement wall structure made according to the invention.

In another embodiment shown in FIGS. 4 and 5 without mold cavity panels, wall structure 25 includes juxtaposed foam inserts 30 with base sections 32 and cap sections 34 embedded in concrete 36. The overall depth of wall structure 25 in this embodiment is about 11¾". The embedded inserts 30 displace about 4" of the concrete at corrugations or cap sections 34 in the wall and about 2" of concrete at the adjacent outer edge portions of inserts 30 as shown in FIG. 5. Vertically disposed metal re-bar rods ½" in diameter extend upwardly within concrete 36 and ½" diameter metal rods 40 extend upwardly about 24" from footing 39. Horizontal reinforcement rods 31 are located 24" on center in the concrete 36. Dotted line A shows a 4" width supporting brick 33.

The disposition of the reinforcement rods 18, 38 and 21, 31 in the two embodiments shown provides additional strength to the hardened concrete. In each of the embodiments, vertical rods 18 and 38 are located in concrete 16 and 36 at about 2" from the inside face of insulation inserts 10 and 30. The metal in the shown embodiments is steel and has a diameter that may be cut at the site with hand-cutting tools. Waterproofing and drainage board 22, 42 are disposed on the exterior surface of walls 15, 25. Concrete slabs 23, 23*a* are disposed on grade and against wall insulation 10, 30.

Joint members or strips 13 may have a cross-sectional shape as shown in U.S. Pat. No. 3,994,471 or be formed of two U-shaped members as shown in U.S. Pat. No. 4,426,061 or be formed by two F-shaped strips as shown in U.S. Pat. No. 5,692,356. The strips may be formed of a polymeric material such a polyvinyl chloride, polyethylene, polypropylene, nylon, or any other of several available materials. Any one of the disclosed joint members or strips 14 has U-shaped sockets that encompass the outer edges of the juxtaposed inserts 10. Dry wall may be attached to the strips to finish the insulated concrete on its interior surface.

Extensions 13*a* connected to the outside surface of the sockets are directed inwardly to be embedded in the concrete thereby helping to hold the inserts in place. As is known, strips 13 include openings vertically spaced to allow tie bars to extend between the mold cavity panels as shown in FIGS. 3 and 5.

Figure 6:
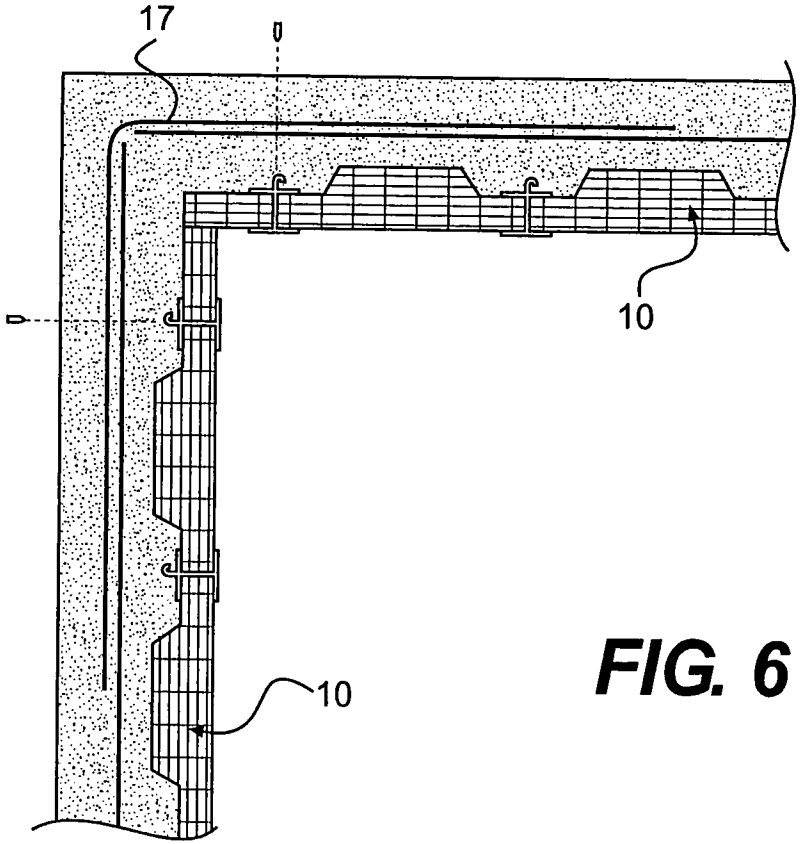
FIG. 6 is a top sectional view of a typical wall corner of the insulated concrete basement wall structures of FIG. 2.

FIG. 6 discloses a ½" diameter bar or rod 17 laterally spaced from the horizontal reinforcement rods and extending about 3" along both sides of the concrete wall. The first strip 13 on either side of the corner is located a maximum distance of about 1' from the inside corner. Similar placement of corner bars and rods are found at other corners in any wall being constructed using the elements of the concrete wall construction of the invention.

While the insulated concrete wall has been shown and described in detail, it is obvious that this invention is not to be considered as limited to the exact form disclosed, and that changes in detail and construction may be made therein within the scope of the invention without departing from the spirit thereof.

I claim:

1. An insulation insert shaped to be embedded in a concrete wall structure, said insert consisting essentially of:

a) an elongate, rigid foam insert including an integrally formed base section and a single cap section that is symmetrically disposed on the base section, which has a bottom outer base surface and opposed base end sections each with a bottom, outer edge portion surface, an upper, outer edge portion surface to be embedded in the concrete of a concrete wall structure, and each base end section extends to an opposed outer flat end side surface that is perpendicular to said bottom and upper outer edge portion surfaces, said cap section having a top peak cap surface to be embedded in the concrete of a concrete wall structure;

b) said bottom outer base surface being opposed to said upper, top peak cap surface and extends between said opposed outer flat end side surfaces, said bottom outer base surface having a length sufficient to form a vertical interior surface expanse of the concrete wall structure, and said outer flat end side surfaces are sufficient to enable said side surfaces of a plurality of inserts to be placed side-by-side to form a horizontal interior surface expanse of the concrete wall structure and said plurality of inserts thereby provides a corrugated shaped internal construction form including cap section side walls of adjacent inserts to provide a corrugated shape to the concrete that acts to create between cap section side walls of adjacent inserts vertically placed concrete columns in the concrete wall structure whereby said columns provide additional lateral and vertical strength to the wall structure and implements structural integrity to a concrete wall structure;

c) said opposed base end sections each extend about 3" outwardly from opposed intersections of the outer cap surface of said single cap section with the upper, outer edge portion surfaces to the outer flat end side surfaces of the opposed base end sections for disposing an entire top peak cap surface and upper, outer edge portion surfaces of each of said plurality of adjacent inserts in a concrete portion of said concrete wall structure;

d) said opposed base end sections and cap section each have a thickness of about 2" so that the insert has a thickness of about 4" at its base and cap sections;

e) said insert has an overall width between the outer, flat end side surfaces of the opposed base end sections selected from a group of about 15¾" to about 17¾", said top peak cap surface of said cap section has a width selected from a group of from about 8" to about 10", and the width between intersections where the symmetrically disposed cap section intersects the base section is from about 10" to about 12".

2. An insulation insert as defined in claim 1, wherein said insert is composed of polystyrene foam or any other suitable foam insulation.

3. An insulation insert as defined in claim 1, wherein said insert is composed of polymeric material selected from the group of polyvinyl chloride, polyethylene, polypropylene, and nylon.

4. An insulation insert as defined in claim 1, wherein said top peak cap surface includes two inclined side walls each extending from an outer end intersection of the cap and base sections to opposed outer ends of the width of the top of the peak cap section; and each inclined side wall extends less than about 1" outwardly of the width of the peak cap surface and depends on the amount of incline of the inclined surface portions.

5. An insulated concrete wall structure for a building, said wall structure consisting essentially of:

a) an outer concrete portion and an inner insulation portion being effective to produce a saving of concrete;

b) said insulation portion including a plurality of shaped vertically disposed elongate, rigid foam insulation inserts each having an integrally formed base section and a cap section symmetrically disposed on the base section;

c) said cap section including a flat, top surface and two opposing inclined side walls each extending from intersections of the cap and base sections to opposed ends of said flat, top surface of the cap section, said cap section side walls of adjacent inserts act to create between adjacent inserts vertically placed corrugated concrete columns in the concrete wall structure whereby the columns provide additional lateral and vertical strength to the wall structure;

d) each said base section includes opposed base end sections each with a bottom, outer edge portion surface, and an upper, outer edge portion surface that is embedded in said outer concrete portion, and each base end section extends about 3" outwardly from each intersection of the cap and base sections to opposed outer flat end side surfaces that are perpendicular to said bottom and upper outer edge portion surfaces;

e) coupling means for grasping facing flat end side edge surfaces with said perpendicular bottom and upper outer edge portion surfaces of juxtaposed inserts, to interconnect facing flat end side edge surfaces of said juxtaposed inserts in their side-by-side disposition; and f) vertical re-bar and horizontal reinforcement rods are located within the concrete portion to provide strength compensation for the lesser amount of concrete used in the production of said concrete wall structure.

6. An insulated concrete wall structure as defined in claim 5, wherein each insert has a length sufficient to form a vertical interior surface expanse of the concrete wall structure.

7. An insulated concrete wall structure as defined in claim 5, wherein said coupling means includes edge strips selected from the group of F-shaped edge strips, H-shaped edge strips, and C-shaped edge strips that fit over and receive adjacent facing flat end side edge surfaces with said perpendicular bottom and upper outer edge portion surfaces of juxtaposed insulation inserts, each said edge strip has inwardly directed projections that are embedded in said concrete portion and are effective to hold the insulation panels in place.

8. An insulated concrete wall structure as defined in claim 5, wherein said two cap section side walls each extend from an outer end intersection of the cap and base sections to opposed outer ends of the width of the top of the peak cap section; and each inclined side wall extends outwardly of the width of the peak cap surface and depends on the amount of incline of the inclined surface portions.

9. An insulated concrete wall structure as defined in claim 8, wherein the overall depth thickness of the wall structure is selected from the group of about 9¾" to about 11¾"; and the embedded inserts displace about 4" of the concrete at said cap sections in the wall and about 2" of concrete at the adjacent outer edge portions of said inserts.

10. An insulated concrete wall structure as defined in claim 5, wherein said embedded insulation inserts form the interior of the concrete portion and create a corrugated concrete shape construction needed to provided structural integrity to the insulated concrete wall structure.

11. A method for producing an insulated concrete wall structure, said method comprising:

a) vertically disposing laterally spaced inner and outer molding surfaces to provide a wall mold cavity for forming said wall structure, said wall mold cavity having an upwardly directed top opening into which hardenable material is to be poured and hardened to produce said wall structure within said wall mold cavity, b) disposing an inner insulation portion against said inner molding surface to effectively produce a saving of concrete, said insulation portion including a plurality of shaped elongate insulation inserts each including an integrally formed base section and a single cap section that is symmetrically disposed on the base section to form opposed intersections therebetween, said base sections each has opposed end wall sections each with a bottom, outer edge portion surface, and an upper, outer edge portion surface, and each end wall section extends to an opposed outer flat end side surface that is perpendicular to the bottom and upper, outer edge portion surfaces, and said upper, outer edge portion surfaces, and said cap sections each has a top peak cap surface that are to be embedded in the concrete of a concrete wall structure;

c) said elongate inserts each including outer edge portions each having a bottom and upper, edge potion surface and said flat end side edge surfaces that face adjacent inserts, and coupling means for grasping said bottom and upper, outer edge portion surfaces and said facing flat end side edge surfaces of juxtaposed inserts to interconnect juxtaposed inserts in their side-by-side disposition;

d) said inserts each including opposed base end sections each extending about 3" outwardly from said opposed intersections of the top peak cap surface of said single cap section to the outer flat end side surfaces of the opposed base end sections for disposing said top peak cap surface and upper, outer edge portion surfaces of each of said plurality of adjacent inserts in the concrete of said concrete wall structure;

e) said opposed end sections and cap section each have a thickness of about 2" so that the insert has a thickness of about 4" at its base and cap sections;

f) said insert has an overall width between the outer side surfaces of the outer opposed end sections selected from a group of about 15¾" to about 17¾", said flat top of the cap section has a width selected from a group of from about 8" to about 10", and the width between intersections where the symmetrically disposed cap section intersects the base section is from about 10" to about 12":

g) disposing vertical re-bar at locations in the molding cavity laterally spaced inwardly from the coupling means connecting said outer edge portion surfaces of insulation inserts;

h) disposing horizontal reinforcement rods at locations within the molding cavity to provide strength compensation for the lesser amount of concrete used in the production of said concrete wall structure;

i) pouring hardenable material into said top opening and allowing it to harden to produce said insulated wall structure within said wall mold cavity having said embedded insulation inserts located on the interior of the mold cavity to create a shaped concrete construction needed to provide structural integrity to the insulated concrete wall structure; and j) removing said inner and outer molding surfaces of said wall mold cavity to reveal said concrete construction.

12. A method as defined in claim 11, wherein said horizontal reinforcement rods are laterally spaced within said mold cavity inwardly from the cap sections of the insulation inserts, said rods being disposed at a plurality of vertical locations that are laterally spaced with respect to each other within said mold cavity.

13. A method as defined in claim 11, wherein said plurality of shaped insulation inserts provide a corrugated insulation interior wall covering wherein the cap sections provide a corrugated form including cap section side walls that act to create between adjacent inserts vertically placed columns in the hardened concrete wall structure whereby said columns provide additional lateral and vertical strength to the wall structure.

14. An insulated concrete wall structure as defined in claim 5, wherein said coupling means includes H-shaped edge strips that fit over and receive adjacent facing flat end side edge surfaces with said perpendicular bottom and upper outer edge portion surfaces of juxtaposed insulation inserts, each said edge strip has inwardly directed projections that are embedded in said concrete portion and are effective to hold the insulation panels in place.

15. An insulation insert as defined in claim 1, wherein said base section has a width between the outer side surfaces of the outer opposed end sections of about 15¾" for a mold cavity panel having a width of about 32".

16. An insulation insert as defined in claim 1, wherein said base section has a width between the outer side surfaces of the outer opposed end sections of about 17¾" for a mold cavity panel having a width of about 36".

17. A method for producing a concrete building panel, said method comprising:

a) providing a form having an upper end, a lower end, lateral edges extending therebetween, and a flat, horizontally disposed mold cavity side portion on which said form is placed to receive elements of the concrete building panel;

b) providing a plurality of elongate, rigid foam inserts each including an integrally formed base section and cap section that is symmetrically disposed on the base section that includes opposed base end sections each with a bottom, outer edge portion surface, and an upper, outer edge portion surface, and each base end section extends about 3" to an opposed outer flat end side edge surface that is perpendicular to said bottom and upper outer edge portion surfaces, and said cap section includes an top peak cap surface and the base section includes a bottom surface extending between opposed outer flat end side edge surfaces;

c) said opposed base end sections each extends from opposed intersections of the top peak cap surface with the upper, outer edge portion surfaces to the outer flat end side surfaces of the opposed base end sections for disposing the top cap surface and upper, outer edge portion surfaces of adjacent inserts in the concrete of said concrete building panel;

d) positioning within said form the plurality of elongate inserts side-by-side with said bottom surfaces of the inserts located side-by-side on said flat, horizontally disposed cavity side portion, and with coupling means grasping said facing flat end side edge surfaces and said perpendicular bottom and upper, outer edge portion surfaces of juxtaposed inserts to interconnect said juxtaposed inserts in their side-by-side disposition;

e) positioning reinforcement rods within said form at locations laterally inwardly spaced from the coupling means and parallel to the elongate inserts;

f) perpendicularly positioning further reinforcement rods to the parallel reinforcement rods within said form at locations inwardly laterally spaced from the outer peak cap surfaces and the upper, outer edge portion surfaces of the base sections of said juxtaposed inserts; and g) pouring hardenable concrete material into the mold cavity to form an outer concrete portion over the inserts and rods to embed the outer peak cap surfaces, the upper, outer edge portion surfaces of the base sections, and the rods in an outer concrete portion and allowing the concrete portion to harden to form said concrete building panel; and h) removing said concrete building panel from said form.

18. A method for producing a concrete building panel as defined in claim 17, wherein the overall depth thickness of said building panel is selected from the group of from about 9¾" to about 11¾";

said peak of the cap section has a width selected from the group of from about 8" to about 10", and the width between the opposed intersections where the symmetrically disposed cap section intersects the base section is selected from the group of from about 10" to about 12";

said opposed end sections and cap section each have a thickness of about 2" so that the insert has a thickness of about 4" at its base and cap sections;

said insert has an overall width between the outer side surfaces of the outer opposed end sections selected from the group of from about 15¾" to about 17¾", said peak of the cap section has a width selected from the group of from about 8" to about 10", and the width between intersections where the symmetrically disposed cap section intersects the base section is selected from the group of from about 10" to about 12".

* * * * *